US006050925A

United States Patent [19]

Irvin et al.

[11] Patent Number: 6,050,925

[45] Date of Patent: Apr. 18, 2000

[54] EXERCISE APPARATUS AND METHOD

[76] Inventors: James E. Irvin, 1400 W. Folley St., Chandler, Ariz. 85224; Richard J. Pickerel, 3066 E. Nance St., Mesa, Ariz. 85213; Janet A. Martin, 1831 W. Mountain View Cir., Mesa, Ariz. 85201

[21] Appl. No.: 09/032,986

[22] Filed: Mar. 2, 1998

[51] Int. Cl.[7] ..... A63B 21/008

[52] U.S. Cl. ..... 482/111; 482/55; 441/55; 441/56; D21/678

[58] Field of Search ..... 482/55, 93, 111; 441/56, 61; D21/678

[56] References Cited

U.S. PATENT DOCUMENTS

D. 279,919 7/1985 Bedgood ..... D21/198

4,902,005 2/1990 McNeil ..... 272/116

*Primary Examiner*—Richard J. Apley
*Assistant Examiner*—Tam Nguyen
*Attorney, Agent, or Firm*—Parsons & Goltry; Michael W. Goltry; Robert A. Parsons

[57] ABSTRACT

An exercise apparatus comprising a substantially planar panel having a first major surface, a second major surface, first and second grips for receiving the hands of a user and at least one opening extending through the panel from the first major surface to the second major surface, and a shudder carried by the panel and movable between first and second positions for controlling the size of the opening for controlling the resistance to movement of the panel through a viscous fluid.

15 Claims, 5 Drawing Sheets

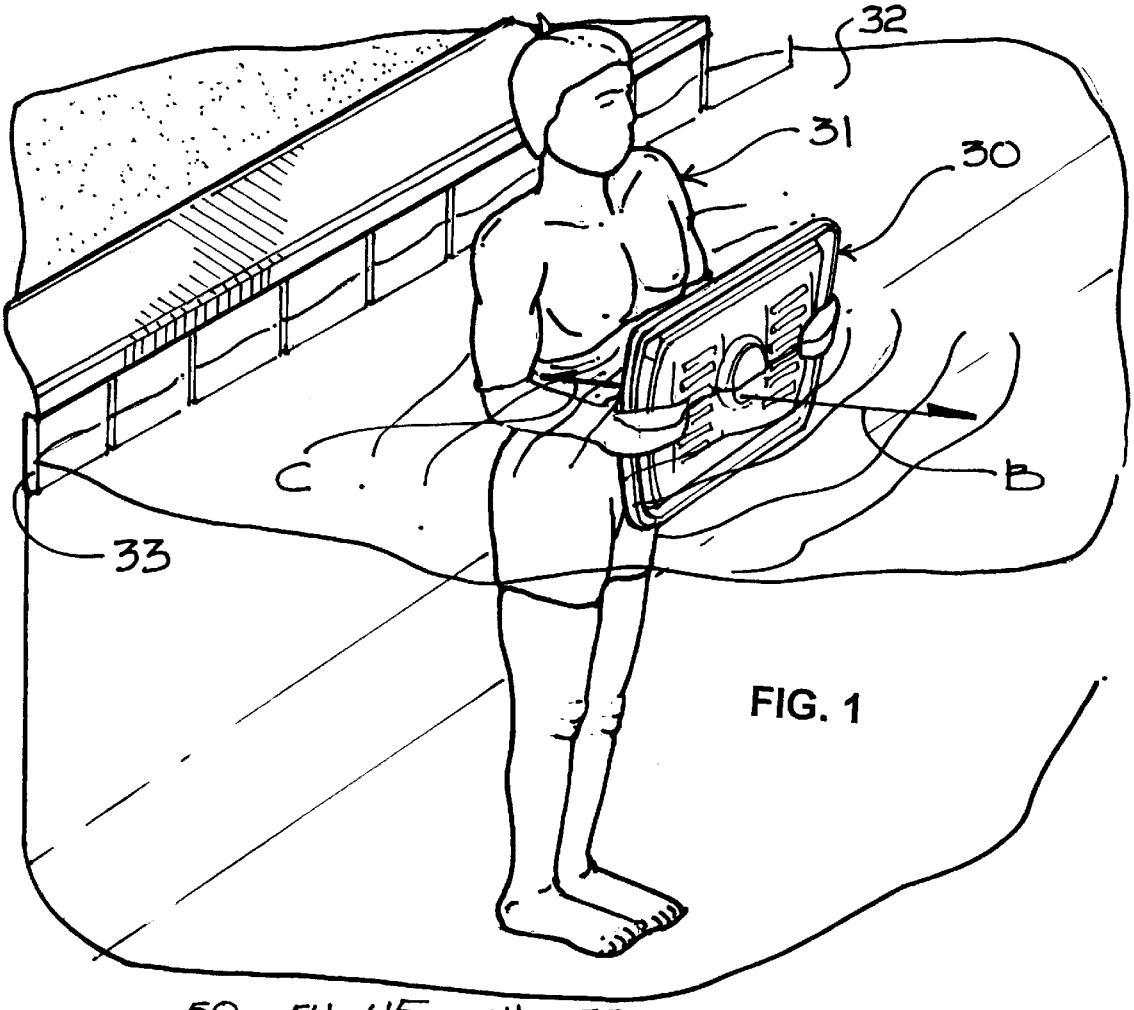
FIG. 1
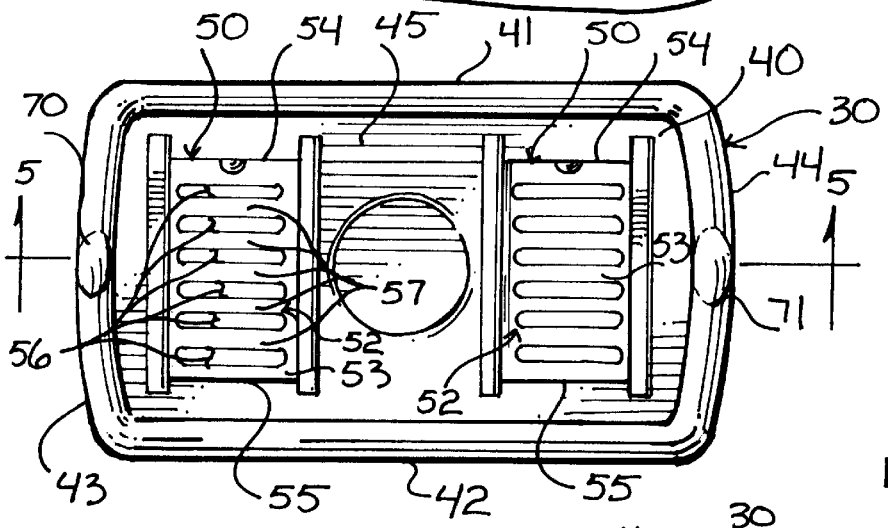
FIG. 2
FIG. 3
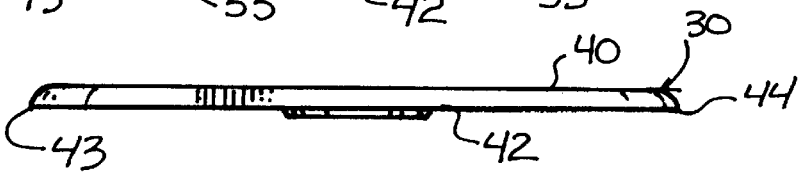

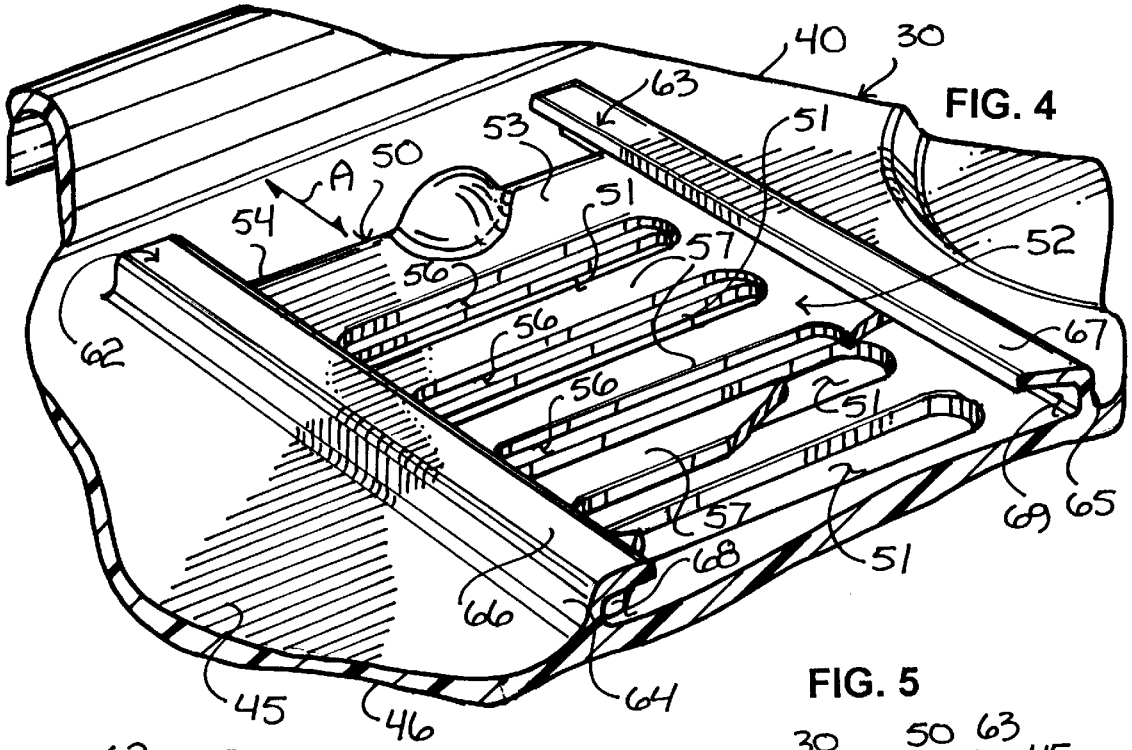
FIG. 4
FIG. 5
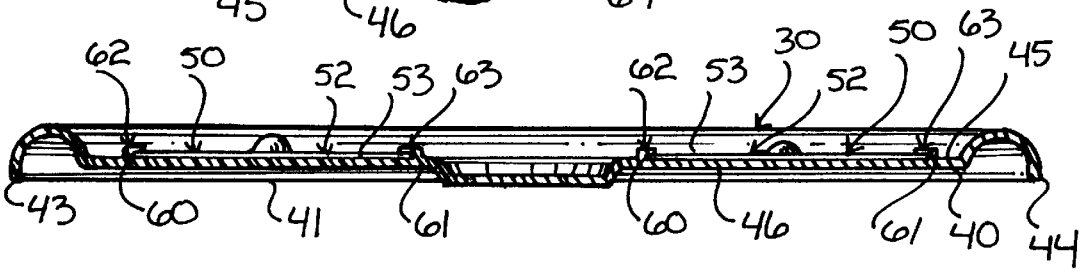
FIG. 6
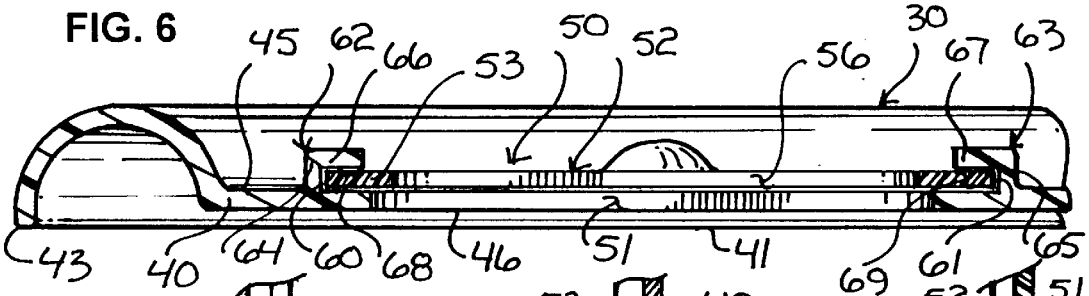
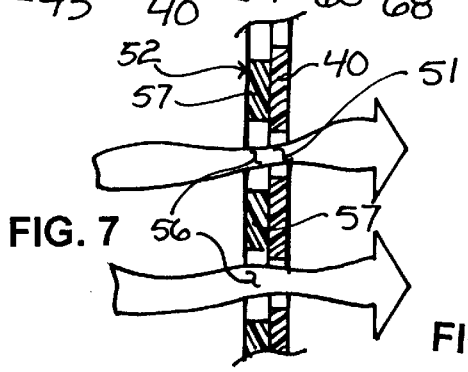
FIG. 7
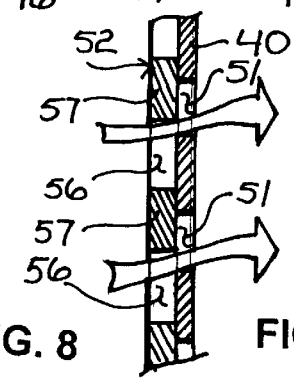
FIG. 8
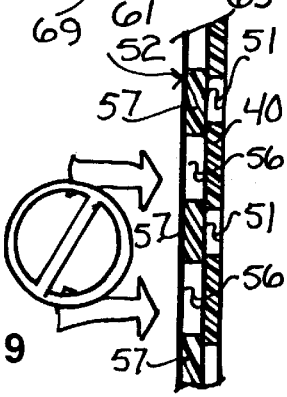
FIG. 9

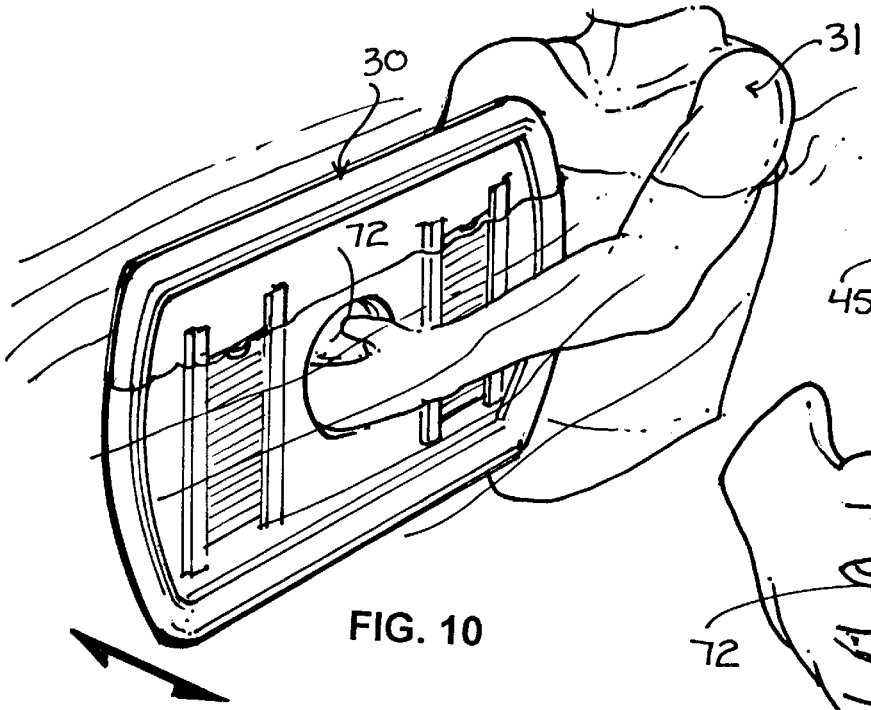
FIG. 10
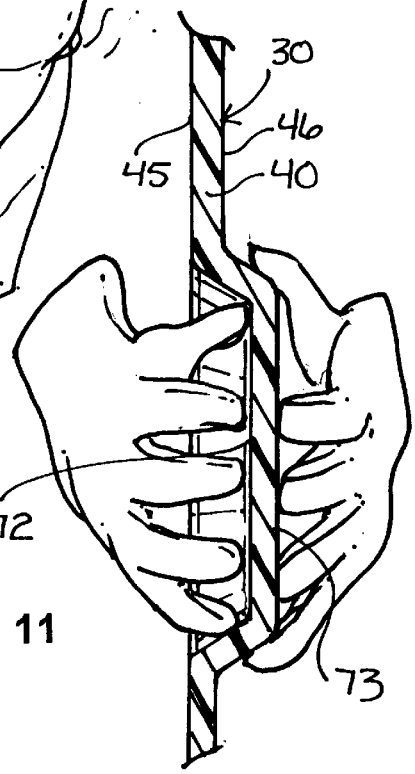
FIG. 11
FIG. 12
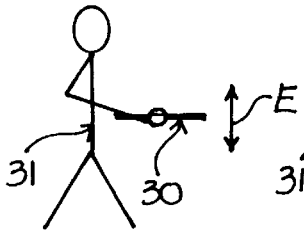
FIG. 13
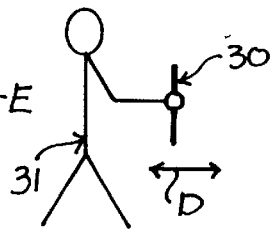
FIG. 14
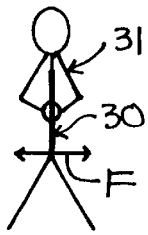
FIG. 15
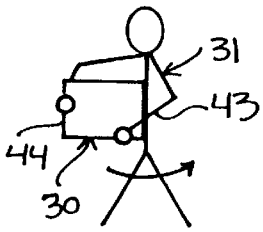
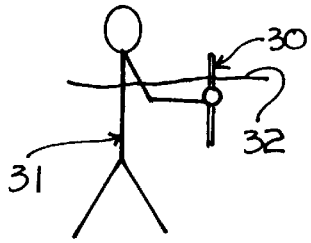
FIG. 16
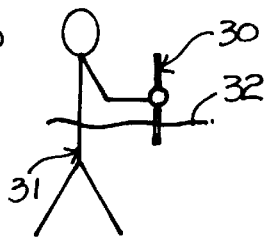
FIG. 17
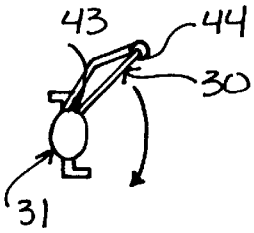
FIG. 18

EXERCISE APPARATUS AND METHOD

BACKGROUND OF THE INVENTION

1. Field of the Invention

This invention relates generally to the field of exercise apparatus.

More particularly, this invention relates to exercise apparatus for use with a viscous fluid.

In a further and more specific aspect, the present invention relates to an apparatus for providing and controlling the resistance of the apparatus to movement through a viscous fluid.

2. Prior Art

The prior art is replete with exemplary apparatus operative for allowing users to target specific muscle groups and to engage in one or more desired forms of cardiovascular exercise. The desire for fitness and its increasing popularity in recent years among many throughout the world has motivated artisans in the art to invest considerable time and effort toward improving exercise apparatus and methods.

Aquatic or water aerobic exercise and other forms of aquatic-oriented exercise have become immensely popular among exercise physiologists and fitness experts as an exemplary form of low impact, efficient exercise. In this regard, rather than using free weights and weight machines, or otherwise engaging in high or low impact aerobic exercise or perhaps traditional aerobic exercise such as running, biking, etc., aquatic-oriented exercise allows for not only aerobic exercise, but also resistance training by users pushing and pulling their arms into and through the water.

Although aquatic-oriented exercise has proven to be safe and efficient, little has been done to increase not only the efficiency of exercise, but also the variety, thus necessitating certain new and useful improvements.

It would be highly advantageous, therefore, to remedy the foregoing and other deficiencies inherent in the prior art.

Accordingly, it is an object of the present invention to provide an apparatus for providing resistance to movement through a viscous fluid.

Another object of the present invention is to provide an apparatus that is easy to construct.

And another object of the present invention is to provide an apparatus that is easy to use.

Still another object of the present invention is to provide an apparatus that is inexpensive.

Yet another object of the instant invention is to provide an apparatus that provides for safe and efficient exercise.

Yet still another object of the instant invention is the provision of enhancing the variety of aquatic-oriented exercise.

And a further object of the invention is to provide an apparatus that may be selectively adjusted for controlling the resistance to movement through a viscous fluid.

Still a further object of the immediate invention is to provide a new and improved method of aquatic-oriented exercise.

Yet a further object of the invention is to provide a new and improved method of providing and controlling the resistance to movement through a viscous fluid.

SUMMARY OF THE INVENTION

Briefly, to achieve the desired objects of the instant invention in accordance with a preferred embodiment thereof, provided is an exercise apparatus comprising a substantially planar panel having a first major surface, a second major surface, first and second spaced-apart grips for receiving the hands of a user and at least one opening extending through the panel from the first major surface to the second major surface. Further included is a shudder carried by the panel and movable between first and second positions for controlling the size of the opening to correspondingly control the resistance to movement of the panel through a viscous fluid.

Regarding a preferred embodiment, the first major surface defines a surface area substantially equal to the extent of the upper torso of the user in one of the first and second positions of the shudder, and the second major surface defines a surface area substantially equal to the extent of the upper torso of the user in one of the first and second positions of the shudder. The shudder of the present invention includes a body carried by one of the first and second major surfaces for rotational movement or movement in reciprocal directions adjacent the opening for controlling the size of the opening.

Consistent with the foregoing, associated methods may also be provided.

BRIEF DESCRIPTION OF THE DRAWINGS

The foregoing and further more specific objects and advantages of the present invention will become readily apparent to those skilled in the art from the following detailed description thereof taken in conjunction with the drawings in which:

FIG. 1 illustrates an apparatus shown as it would appear in use for exercise;

FIG. 2 illustrates a top plan view of the apparatus of FIG. 1;

FIG. 3 illustrates a side elevational view of the apparatus of FIG. 1;

FIG. 4 illustrates an enlarged fragmented perspective view of the apparatus of FIG. 1 showing an assembly for controlling the resistance to movement of the apparatus through a viscous fluid;

FIG. 5 illustrates a sectional view taken along line 5—5 of FIG. 2;

FIG. 6 illustrates an enlarged vertical sectional view of the assembly of FIG. 4;

FIG. 7 illustrates a longitudinal sectional view of the assembly of FIG. 4 shown as it would appear in a first phase of operation;

FIG. 8 illustrates a longitudinal sectional view of the assembly similar to the view of FIG. 7 and further showing the assembly as it would appear in a second phase of operation;

FIG. 9 illustrates a longitudinal sectional view of the assembly similar to the view of FIG. 8 and further showing the assembly as it would appear in a third phase of operation;

FIG. 10 illustrates the apparatus of FIG. 1 shown as it would appear in use by a user for exercise;

FIG. 11 illustrates a vertical sectional view of the apparatus of FIG. 10 and further shown being gripped by a user;

FIG. 12 illustrates a schematic representation of the apparatus of FIG. 1 shown as it would appear in use by a user in a first mode of exercise;

FIG. 13 illustrates a schematic representation of the apparatus of FIG. 1 shown as it would appear in use by a user in a second mode of exercise;

FIG. 14 illustrates a schematic representation of the apparatus of FIG. 1 shown as it would appear in use by a user in a third mode of exercise;

FIG. 15 illustrates a schematic representation of the apparatus of FIG. 1 shown as it would appear in use by a user in a fourth mode of exercise;

FIG. 16 illustrates a view similar to the view of FIG. 13;

FIG. 17 illustrates a view similar to the view of FIG. 16;

FIG. 18 illustrates a schematic representation of the apparatus of FIG. 1 shown as it would appear in use by a user in a fifth mode of exercise;

DETAILED DESCRIPTION OF THE PREFERRED EMBODIMENT

Figure 19:
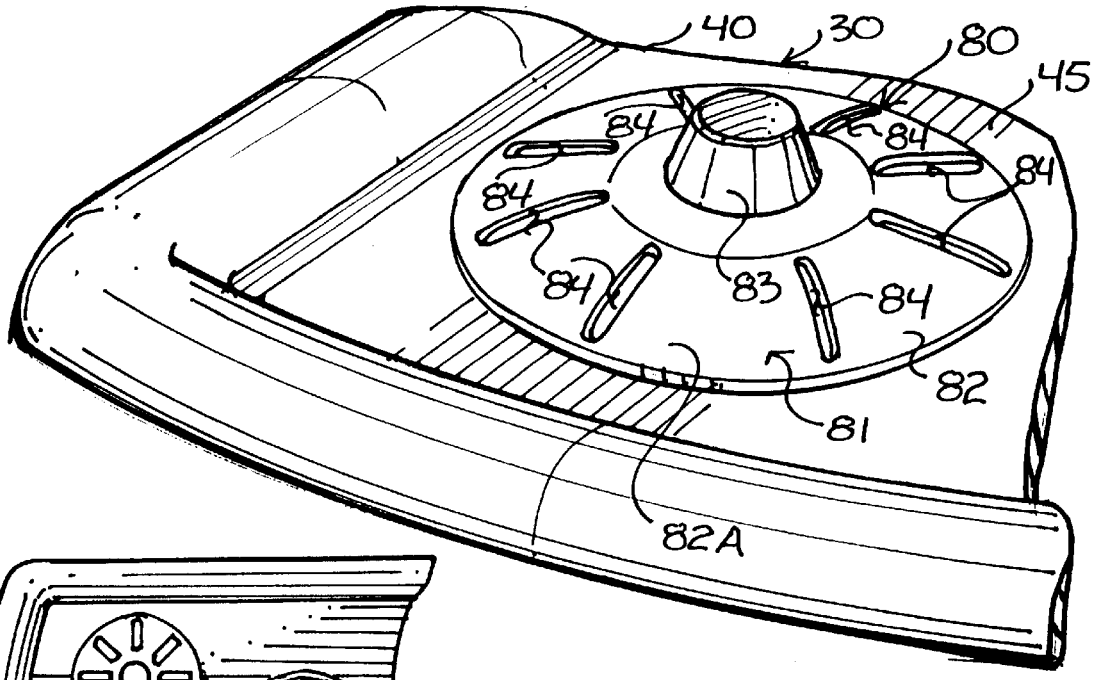
FIG. 19 illustrates an enlarged perspective view of an alternate embodiment of an assembly for controlling the resistance to movement of the apparatus of FIG. 1 through a viscous fluid.
Figure 20:
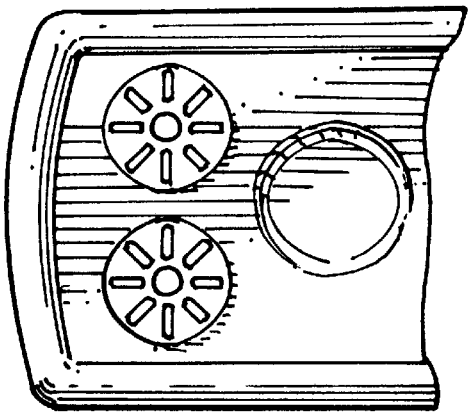
FIG. 20 illustrates a fragmented top plan view of the apparatus of FIG. 1 shown as it would appear having a plurality of the assemblies of FIG. 19.

The present invention provides, among other things, an apparatus and method for providing and controlling the resistance of the apparatus to movement through a viscous fluid. The apparatus provides for a variety of exemplary exercises a user may engage in for targeting specific muscle groups and for providing cardiovascular work.

Turning now to the drawings, in which like reference characters indicate corresponding elements throughout the several views, attention is first directed to FIG. 1 illustrating a perspective view of an apparatus 30 shown as it would appear in use by a user 31 for exercise. Apparatus 30 is specifically constructed to provide resistance to a user's movement of the apparatus 30, either partially or totally, into and through a viscous fluid shown, in this specific example, as water 32 carried by a conventional pool structure 33.

Referring to FIG. 2, apparatus 30 is generally comprised of a substantially planar panel 40 formed, in this specific example, substantially in the shape of a rectangle, panel 40 having side edges 41 and 42 and end edges 43 and 44 (shown also in FIG. 3). Panel further includes a first major surface 45 and, as shown in FIG. 5, a second major surfaces 46. As shown in FIG. 2, the panel still further includes a plurality of spaced-apart adjustment assemblies, each being substantially identical and generally designated by the reference character 50. Although apparatus 30 is shown as having two adjustment assemblies 50 in FIG. 2, less or more may be used depending upon the needs of the user consistent with the present teachings.

Regarding FIG. 4, each adjustment assembly 50 is generally comprised of a plurality of apertures or openings 51 formed through panel 40 from first major surface 45 to second major surface 46. In the specific example shown in FIG. 4, openings 51 are elongate, substantially equally spaced-apart and arranged in series. Further included is a shudder 52 mounted with panel 40 adjacent and in substantial opposition to openings 51. Shudder 52 is comprised of a body 53 having first and second ends 54 and 55 (second end 55 shown in FIG. 2) and a plurality of apertures or openings 56 formed therethrough body 53. In the specific example shown in FIGS. 2 and 4, openings 56 are elongate, substantially equally spaced apart, arranged in series and separated by blanks 57 that form part of body 53.

Body 53 is mounted with panel 40 for movement in reciprocal directions adjacent and transverse to openings 51 in the direction generally indicated by the arrowed line A in FIG. 4. In this regard, and with additional attention directed to FIG. 5 illustrating a sectional view taken along line 5—5 of FIG. 2, each body 54 of each shudder 52 includes side edges 60 and 61 each mounted within a first and second way 62 and 63, respectively, so as to be captured for sliding movement. As shown in FIG. 4 and FIG. 6 illustrating an enlarged vertical sectional view of the assembly of FIG. 4, first and second ways 62 and 63 are carried to extend outwardly from first major surface 45 and are disposed in spaced-apart and substantially parallel relation. In an alternate embodiment, first and second ways 62 and 63 may be carried by second major surface 46 if desired. In any event, first and second ways 62 and 63 represent a mirror image of each other are each generally comprised of an upstanding sidewall 64 and 65 each terminating with an inwardly extending endwall 66 and 67. Portions of first major surface 45, each sidewall 64 and 65 and each endwall 66 and 67 cooperate together to define first and second grooves 68 and 69 into which each respective side edge 60 and 61 resides for sliding movement, first and second ways 62 and 63 operating to capture body 53 therebetween for movement in reciprocal directions.

As previously intimated, apparatus 30 provides resistance to a user's movement of apparatus 30 through a viscous fluid. In this regard, a user may grasp panel 40, such as with his or her hands, at grips or handles 70 and 71 formed as recessed portions in panel adjacent edges 43 and 44 shown in FIG. 2. So when the apparatus is grasped as shown in FIG. 1, a user may then hold panel 40 in water 32 spaced from and in a substantially parallel and transverse relation in substantial opposition to the user's trunk or upper torso of which may also be seen substantially in FIG. 13. The user may then urge panel 40 in reciprocal directions relative his or her trunk as generally indicated by the double arrowed line D in FIG. 13 such as by pushing away from his or her trunk in the direction indicated by the arrowed line B in FIG. 1 and by pulling toward his or her trunk in the direction indicated by the arrowed line C in FIG. 1 to move panel 40 into, through and against water 32 to provided desired resistance to movement of panel 40 through the water 32. As the user moves apparatus 30 into and through water 32 in the foregoing manner, bearing the first and second major surfaces 45 and 46 against water 32, the resistance to movement of apparatus 30 into and through water 32 will occasion safe and efficient resistance training operative for strengthening and stabilizing not only the user's abdominal muscles, but also the user's lower back musculature, arms, chest, legs and shoulder muscles via co-contraction of the perspective muscle groups.

The degree of resistance provided with apparatus 30 as a user moves apparatus 30 into and through water 32 in the foregoing manner depends not only on how forcefully the user moves apparatus 30 into and through water 32, but also the surface area defined by first major surface 45 and the surface area defined by second major surface 46. To control the resistance to movement of apparatus 30 into and through water 32, the shudder may be moved and positioned selectively between first and second positions for controlling the size of openings 51 formed through panel 40 for either maximizing or decreasing the surface area of each of the first and second major surfaces 45 and 46. In this regard, openings 56 of shudder 52 are spaced such that in a first position of shudder 52, openings 56 will align substantially with openings 51 decreasing the surface area of each first and second major surface and allowing water 32 to pass therethrough during a user's movement of apparatus 30 into and through water 32 as substantially shown in FIG. 7. Furthermore, shudder 52 may alternately be moved, such as by sliding movement, into a second position to align each blank 57 of shudder to substantially obstruct a corresponding opening 51 maximizing the surface area of each first and second major surface 45 and 46 and inhibiting water from passing through openings 51 during a user's movement of apparatus 30 into and through water 32 as substantially shown in FIG. 9. In the second position of shudder 52 to maximize the surface area of each first and second major surface 45 and 46, apparatus 30 is specifically constructed so that the surface area of each first and second major surface 45 and 46 each are substantially equal to the size or extent of a user's trunk or upper torso. To vary the resistance to movement of apparatus 30 into and through water 32 consistent with the foregoing, shudder 52 may be selectively positioned at any desired location intermediate the first and second locations as shown substantially in FIG. 8 for partially obstructing openings 51.

Apparatus 30 may be used in a variety of different ways for allowing a user to target one or more selected muscle groups for resistance training. For instance, FIG. 12 illustrates how a user may grasp, such as at handles 70 and 71 (not shown in FIG. 12), and hold apparatus 30 in a substantially horizontal orientation and then move apparatus 30 in reciprocal directions up and down as generally indicated by the double arrowed line E. As shown in FIGS. 10 and 11, apparatus 30 may further be provided with a grip or handle 72 carried by and formed as a recess into and through first major surface 45, and another grip or handle 73 in substantial opposition to handle 72 carried by and formed as a raised portion extending outwardly from second major surface 46. In this regard, a user may grasp handles 72 and 73, such as with his or her hands as shown in FIG. 11, and while holding apparatus 30 substantially vertically and perpendicularly relative the user's trunk as shown substantially in FIGS. 10 and 14, move apparatus from side to side into and through the water in reciprocal directions as generally- indicated by the double arrowed line F in FIG. 14.

As an example of another form of exercise, a user may grasp apparatus 30 as shown substantially in FIGS. 15 and 18 and while holding one of the end edges 43 and 44 against the torso with apparatus positioned in a substantially vertical and perpendicular orientation relative the user's body, move apparatus 30 into and the through the water about one of the end edges 43 and 44 against the user's body along lateral pivotal traverse of the other one of the end edges 43 and 44.

Figure 21:
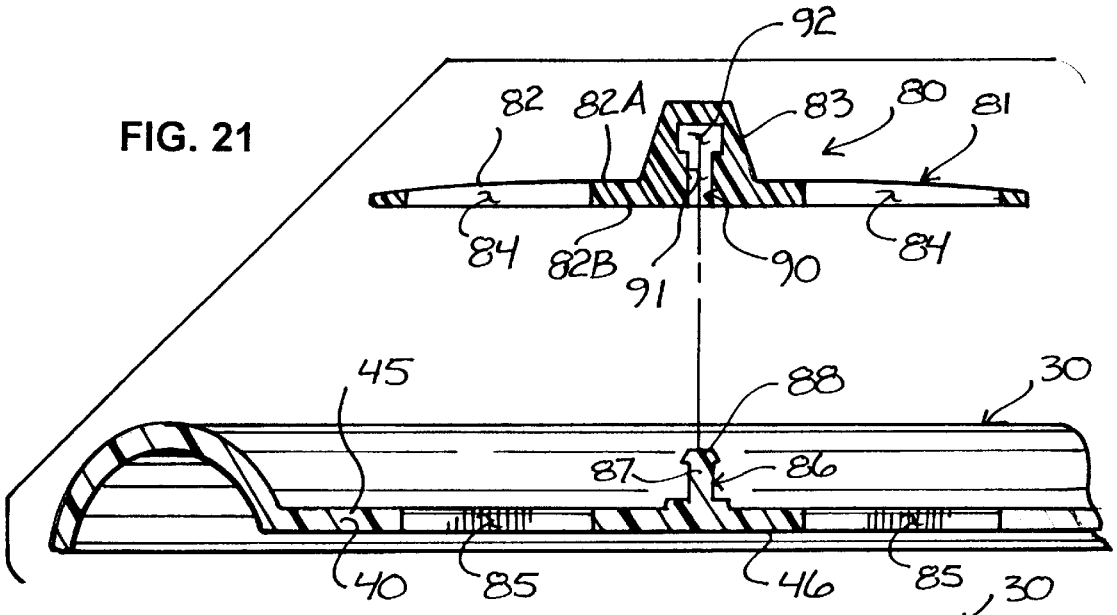
FIG. 21 illustrates a vertical sectional exploded view of the assembly of FIG. 19, the assembly including a body engagable with the apparatus for movement adjacent apertures formed with the apparatus.
Figure 22:
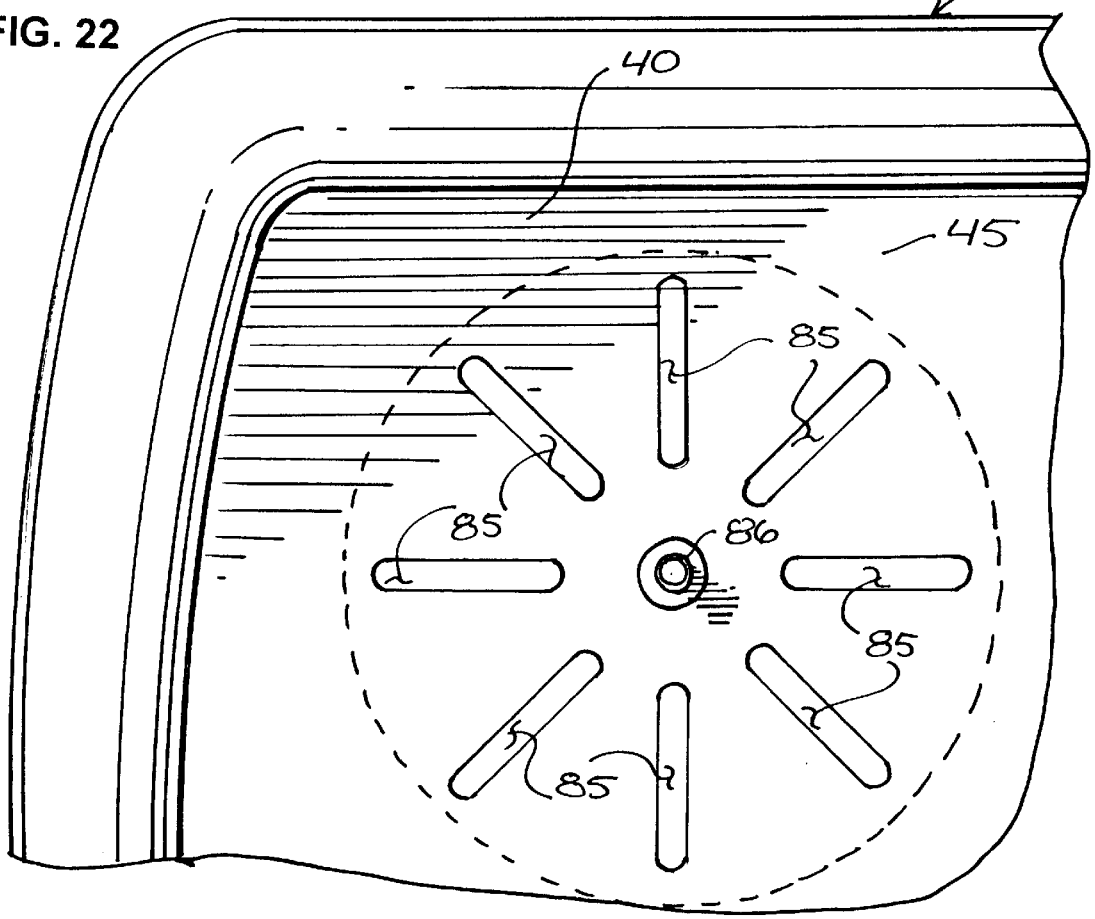
FIG. 22 illustrates a top plan view of the apertures formed through the apparatus as shown in FIG. 21.

Although adjustment assembly 50 has been disclosed as a preferred embodiment for allowing a user to control the resistance to movement of apparatus 30 into and through water 32, FIG. 19 illustrates an enlarged perspective view of an alternate embodiment of an adjustment assembly generally designated by the reference character 80. With attention directed to FIG. 21 illustrating a vertical sectional exploded view of the assembly of FIG. 19, adjustment assembly 80 is generally comprised of a shudder 81 including a substantially annular body 82 having an outwardly extending, substantially centrally disposed handle 83, an outer surface 82A, an inner surface 82B (shown only in FIG. 21) and, as seen in FIG. 19, a plurality of outwardly radially extending and spaced-apart apertures or openings 84 formed therethrough. Adjustment assembly 80 further includes a plurality of apertures or openings 85 formed through panel 40 from first major surface 45 to second major surface 46. In this specific example, openings 85 are elongate, substantially equally spaced-apart and extend radially outwardly in a substantially circumferential pattern.

Shudder 81 may be mounted with panel 40 for rotation adjacent and in substantial opposition to openings 85. To mount shudder 81 with panel 40, provided is an engagement element 86 including a shaft 87 extending outwardly from, in this specific example, first major surface 45 and terminating with a headed free end 88, engagement element 86 being positioned with openings 85 extending radially outwardly therefrom. Further included is a detachably engagable complemental engagement element 90 carried by shudder 81. Complemental engagement element 90 is comprised of a blind bore 91 extending inwardly from inner surface 82B into handle 83 and terminating with an enlargement 92. With inner surface 82B of shudder 81 facing first major surface 45, shudder 81 may be installed for complemental engagement to element 90 to receive engagement element 86 with headed end 88 to admit into and through blind bore 91 for engaging receipt by the enlargement 92.

To vary the resistance of movement of apparatus 30 into and through a viscous fluid, shudder 81 may be rotated between first and second positions for controlling the size of openings 85 formed through panel 40 for either maximizing or decreasing the surface area of each of the first and second major surfaces 45 and 46. In this regard, openings 84 of shudder 81 are spaced such that in a first position of shudder 81, openings 84 may align substantially with openings 85 decreasing the surface area of each first and second major surface and allowing water to pass therethrough during a user's movement of apparatus 30 into and through water 32. Furthermore, shudder 81 may alternately be moved by rotation into a second position for portions of body 82 of shudder 81 to substantially obstruct openings 85 maximizing the surface area of each first and second major surface 45 and 46 and inhibiting water from passing through openings 85 during a user's movement of apparatus 30 into and through a viscous fluid. To vary the resistance to movement of apparatus 30 into and through a viscous fluid, shudder 81 may be selectively positioned at any desired location intermediate the first and second locations for partially obstructing openings 85 as desired.

In summary, the various embodiments of the present invention provide for beneficial therapeutic aquatic-oriented exercise with emphasis, among other things, on lumbar stabilization. Users will benefit from the buoyant properties of, for instance, water to help decrease pressure on sensitive spinal tissue while achieving resistance of water to generate water current to correspondingly occasion lumbar stabilization effects. Gravity is also greatly diminished in the water which will help decrease weight bearing on sensitive joint interfaces. Furthermore, because the various exercises discussed herein are carried out in water consistent with preferred teachings, the water temperature may be controlled to a warmth sufficient to decrease contraction of chronic reactive low back musculature which will also help to decrease low back pain.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An exercise apparatus, comprising:

a substantially planar panel having first and second side edges; and an adjustment assembly mounted between the first and second side edges for controlling the resistance to movement of the panel through a viscous fluid, the adjustment assembly comprising:

a plurality of linearly aligned openings extending through the panel at spaced intervals between the first and second side edges, and a shutter having a plurality of linearly aligned alternating openings and blanks, wherein the shutter is carried by the panel for movement in a reciprocally linear direction between first and second positions for evenly controlling the size of each one of the plurality of openings of the panel for controlling the resistance to movement of the panel through a viscous fluid, wherein in and between the first and second positions of shutter the resistance is evenly distributed between the first and second side edges of the panel, each one of the plurality of openings of the shutter alignable with a selected one of the plurality of openings of the panel in one of the first and second positions of the shutter and each one of the plurality of blanks alignable to obstruct a selected one of the plurality of openings of the panel in the other one of the first and second positions of the shutter.

2. The apparatus of claim 1, wherein the panel includes a first surface area in one of the first and second positions of the adjustment assembly and a second different surface area in the other one of the first and second positions of the adjustment assembly.

3. The apparatus of claim 1, wherein the panel includes grips for accommodating the hands of a user.

4. The apparatus of claim 3, wherein one of the grips is carried by the panel at a first location and another one of the grips is carried by the panel at a second location different from the first location.

5. A method of providing and controlling the resistance to movement of an apparatus through a viscous fluid, the method comprising the steps of:

providing a substantially planar panel having first and second side edges and an adjustment assembly mounted between the first and second side edges, the adjustment assembly comprising:

a plurality of linearly aligned openings extending through the panel at spaced intervals between the first and second side edges, and a shutter having a plurality of linearly aligned alternating openings and blanks, wherein the shutter is carried by the panel for movement in a reciprocally linear direction between first and second positions for evenly controlling the size of each one of the plurality of openings of the panel for controlling the resistance to movement of the panel through a viscous fluid, wherein in and between the first and second positions of the shutter the resistance is evenly distributed between the first and second side edges of the panel, each one of the plurality of openings of the shutter alignable with a selected one of the plurality of openings of the panel in one of the first and second positions of the shutter and each one of the plurality of blanks alignable to obstruct a selected one of the plurality of openings of the panel in the other one of the first and second positions of the shutter;

moving the panel through a viscous fluid; and moving the shutter between the first and second positions for evenly controlling the resistance to movement of the panel through the viscous fluid.

6. The method of claim 5, further including the step of providing the panel with grips for accommodating the hands of a user.

7. The method of claim 6, further including the steps of positioning one of the grips at a first location and positioning another one of the grips at a second location different from the first location.

8. The method of claim 6, further including the step of positioning the grips in substantial opposition relative to one another.

9. In an apparatus, comprising:

a substantially planar panel having first and second side edges and an adjustment assembly mounted between the first and second side edges, the adjustment assembly comprising:

a plurality of linearly aligned openings extending through the panel at spaced intervals between the first and second side edges, and a shutter having a plurality of linearly aligned alternating openings and blanks, wherein the shutter is carried by the panel for movement in a reciprocally linear direction between first and second positions for evenly controlling the size of each one of the plurality of openings of the panel for controlling the resistance to movement of the panel through a viscous fluid, wherein in and between the first and second positions of the shutter the resistance is evenly distributed between the first and second side edges of the panel, each one of the plurality of openings of the shutter alignable with a selected one of the plurality of openings of the panel in one of the first and second positions of the shutter and each one of the plurality of blanks alignable to obstruct a selected one of the plurality of openings of the panel in the other one of the first and second positions of the shutter;

a method of providing and controlling the resistance to movement of the panel through a viscous fluid, the method comprising the steps of:

moving the panel through a viscous fluid; and moving the shutter between the first and second positions for evenly controlling the resistance to movement of the panel through the viscous fluid.

10. The method of claim 9, further including the step of providing the panel with grips for accommodating the hands of a user.

11. The method of claim 10, further including the steps of positioning one of the grips at a first location and positioning another one of the grips at a second location different from the first location.

12. The method of claim 10, further including the step of positioning the grips in substantial opposition relative to one another.

13. The apparatus of claim 1, wherein the shutter includes edges each mounted within one of a plurality of ways supported by the panel for sliding movement in the reciprocally linear direction.

14. The apparatus of claim 13, wherein the panel carries structure that cooperates with a surface of the panel to define the ways.

15. The apparatus of claim 13, wherein the ways are spaced apart in substantially parallel relation.

* * * * *